US008707466B2

(12) United States Patent
Reynolds

(10) Patent No.: US 8,707,466 B2
(45) Date of Patent: Apr. 29, 2014

(54) CONCEALED CARRY GARMENT

(76) Inventor: Andrew Reynolds, Grove City, OH (US)

( * ) Notice: Subject to any disclaimer, the term of this patent is extended or adjusted under 35 U.S.C. 154(b) by 56 days.

(21) Appl. No.: 13/289,868

(22) Filed: Nov. 4, 2011

(65) Prior Publication Data

US 2012/0227152 A1 Sep. 13, 2012

Related U.S. Application Data

(63) Continuation-in-part of application No. 13/046,128, filed on Mar. 11, 2011.

(51) Int. Cl.
*A41D 1/04* (2006.01)

(52) U.S. Cl.
USPC ..... 2/102; 2/217

(58) Field of Classification Search
USPC ..... 2/102, 217
See application file for complete search history.

(56) References Cited

U.S. PATENT DOCUMENTS 5,101,514 A * 4/1992 Eklund ..... 2/94
5,692,237 A * 12/1997 Bennett ..... 2/93
2012/0174286 A1* 7/2012 McBride et al. ..... 2/102

* cited by examiner

*Primary Examiner* — Katherine Moran
(74) *Attorney, Agent, or Firm* — Porter Wright Morris & Arthur, LLP

(57) ABSTRACT

A garment adapted for concealed carry weapons users wherein a passageway within or upon the garment is adapted to receive a flexible cord. The passageway extends from an opening on an upper exterior of the garment to a lower section of the garment. The cord is attached at an end of the passageway at the lower section and extends through the passageway, through the opening, and to a second attachment point at a removable piece. The removable piece releasably attachable to the garment. When worn, to gain access to a weapon under the garment, the user grasps the removable piece and pulls it away from the garment, raising the lower section of the garment and allowing access to the weapon. When the removable piece is replaced, the lower section lowers to its original position.

10 Claims, 7 Drawing Sheets

CONCEALED CARRY GARMENT

CROSS-REFERENCES TO RELATED APPLICATIONS

This patent application is a continuation in part of patent application Ser. No. 13/046,128 ("Yank and Draw Concealed Carry Garment") filed Mar. 11, 2011, hereby incorporated by reference.

BACKGROUND OF THE INVENTION

The present invention relates to improvements in apparel worn by licensed concealed carry weapons users and allows a quick, easy and unobstructed weapons draw when a user is wearing the garment described herein.

In the prior art concealed carry handgun pistol holsters and carriers are known. However, when a weapon such as a handgun is covered or concealed by an outer garment, quick access to the concealed weapon may be hindered as an outer garment may obstruct removal of the handgun from its holster or carrier location when quick access to the weapon is necessary.

There are several ways of drawing a weapon from under a concealment garment. First, when wearing a pullover garment: You reach over with your support side hand, grab hold of the bottom edge of the garment under the weapon and pull the garment up and over the weapon. Because of a person's size, agility or lack of practice, this method can be impossible or too slow. Second, when an open or unsecured vest is worn, the draw involves using the hand that you are drawing the weapon with, cupping your fingers over the front opening of the garment and sweeping the side of the garment back far enough to get a good grip on the weapon. In this instance, the front of the garment must be open or able to be opened quickly. It also takes a lot of practice to become proficient.

SUMMARY OF THE INVENTION

The present invention is directed to overcoming the problems set forth above. It is an object of the present invention to facilitate a quick draw of a weapon when a holstered handgun is covered by a garment, namely, to unencumber access to the weapon concealed by a garment. The present invention is a garment comprising a concealed passageway within or upon the garment adapted to receive a flexible cord. The passageway extends from an opening on an upper exterior of the garment to a lower section of the garment. The cord is attached at an end of the passageway at the lower section and extends through the passageway, through the opening, and to a second attachment point at a removable piece. The removable piece is releasably attachable to the garment. The removable piece is an item that normally appears on garments, such as but not limited to an epaulette, a shoulder tab, a button, an artificial flower, a handkerchief, a piece of jewelry, a collar, a lapel, and the like. The removable piece is removeably attached by a fastener, such as but not limited to a snap, a tab, a clip, a hook, a hook and loop-type fastener, and the like. The lower section of the garment is a bottom of the garment at a side seam. The removable piece may be located on the left or right side of the garment, or the garment may have two passageways, with a first passageway extending from a lower section of the garment at a bottom of the garment at first side seam, and a second passageway extending from the bottom of the garment at a second side seam. Each passageway encloses a cord attached individual removable pieces. In an embodiment, the garment is a shirt and the removable piece is a shoulder tab.

A user uses the garment to access to a concealed weapon worn on his/her belt by: a) donning the garment with a concealed weapon covered by the garment; b) grasping the removable piece; and c) pulling the removable piece in a direction away from the garment. The pulling movement raises the lower section and allows access to the weapon. When the user wants to release the pulled lower section, he/she replaces the removable piece and the lower section lowers to its original position.

As used herein, "approximately" means within plus or minus 25% of the term it qualifies. The term "about" means between ½ and 2 times the term it qualifies.

The compositions and methods of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

Terms such as "top," "bottom," "right," "left," "above", "under", "side" "front" and "back" and the like, are words of convenience and are not to be construed as limiting.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
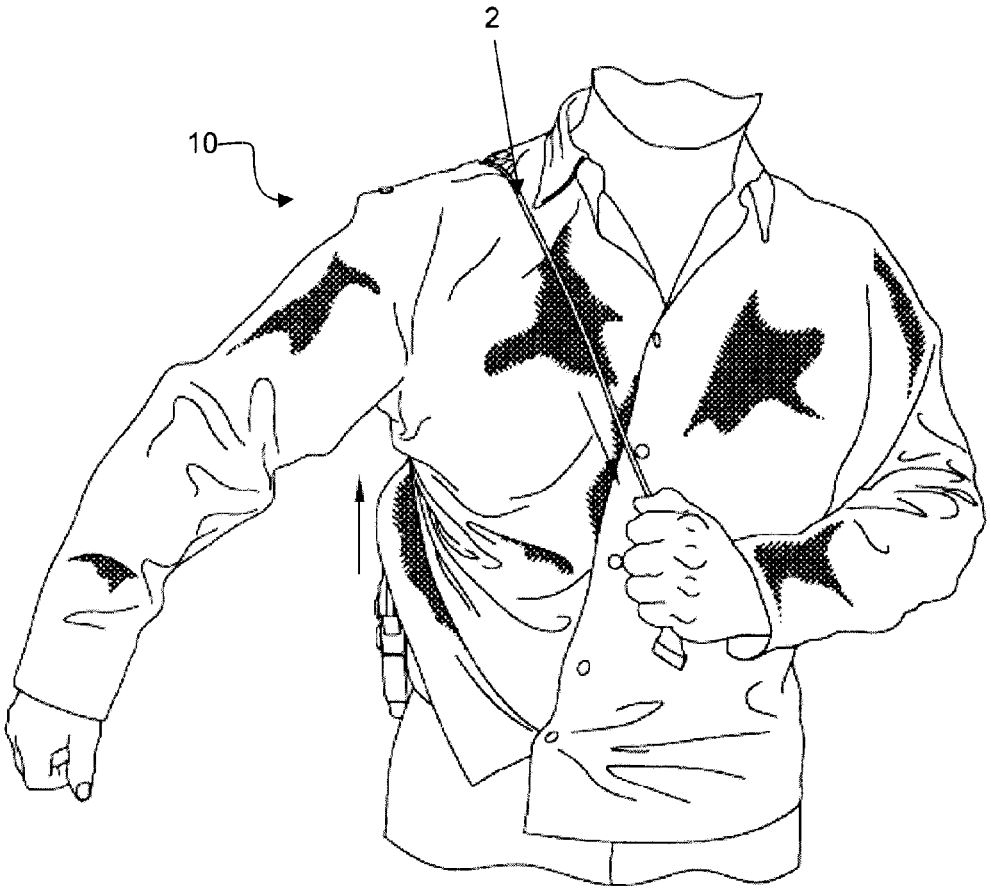
FIG. 1 is a front perspective view of an embodiment of the invention.

Reference will now be made in detail to the exemplary embodiments of the invention, examples of which are illustrated in the accompanying drawings. As shown in FIG. 1, the invention is an upper torso garment that allows a user of a concealed carry weapon a quick, easy and unobstructed weapon draw. The garment includes a passageway or tunnel within or upon the garment adapted to receive a longitudinally extending flexible cord or lanyard. The passageway extends from the shoulder of the garment to a lower section of the garment body. The cord extends outside the garment from an opening in the passageway at the shoulder where it is reachable by the user. The lower end of the pull is secured to the garment at a location on the garment proximate a concealed weapon carried by the wearer beneath the garment. The terminal exterior section of the cord is concealed in a removable piece. The removable piece is preferably something that would normally appear on a garment, such as but not limited to, an epaulette or shoulder tab that extends inward from the sleeve seam and terminates typically with a button, at the edge of the collar, an artificial flower, a handkerchief in a pocket, a piece of jewelry, a collar or lapel, and the like. When the user pulls the removable piece downward, the cord pulls the lower section upward, raising the garment and allowing unimpeded access to the otherwise concealed weapon.

In variations, the garment can be made of multiple layers of material (e.g., a textile materials, leather, polymeric materials, nylon webbing, vinyl or other garment material or any other suitable material that is strong and flexible) forming the garment wherein a passageway is created between two of the layers. In another variation, the passageway may comprise a tunnel adapted to receive the pull wherein the tunnel is affixed to a layer of material forming the garment, or the tunnel may be affixed to the exterior of the garment, or configured in the interior of the garment.

Figure 2:
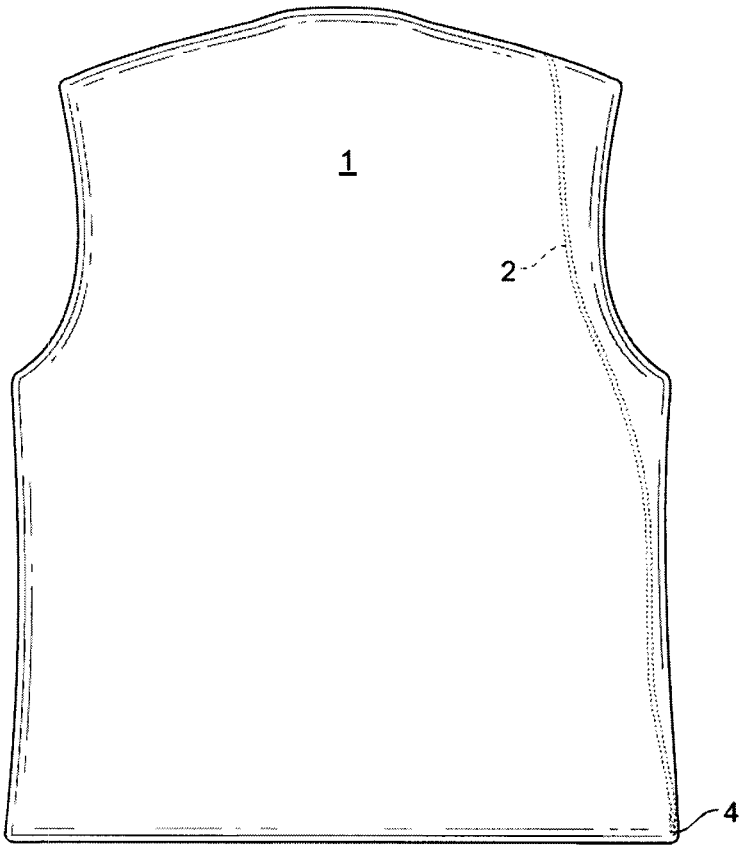
FIG. 2 is a back view of an embodiment of the body of the invention.

Referring to the embodiment depicted in FIG. 1, the garment 10 is shown as a shirt, but any garment, such as a vest, coat, shawl, jacket, or any article of clothing that would conceal a weapon and provide an area to place a piece to act as an end for a pull cord can be used. Cord 2 is any strong, flexible cord, wire, rope, can be braided or twisted, and is secured (by stapling, sewing, heat bonding and the like) to the inside bottom of the side seam of the body 1 as indicated at 4 (see FIG. 2). In an embodiment, the cord 2 is parachute cord. The cord is positioned depending on which side a person wears a weapon (left side is a mirror image of the right). In an embodiment, the garment comprises a cord on each side of the garment.

Figure 3:
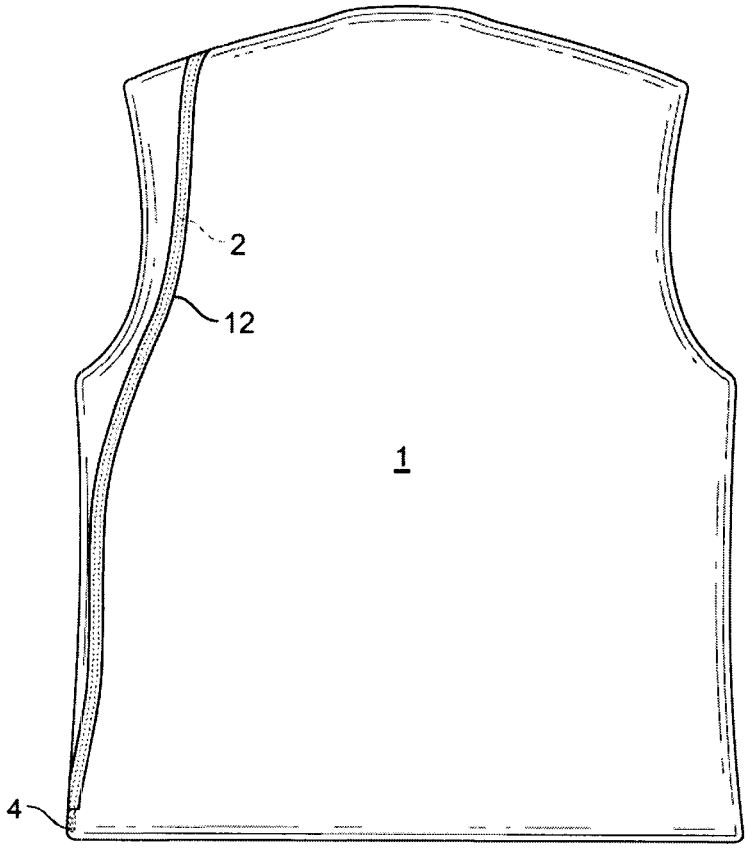
FIG. 3 is an inside view of an embodiment of the body of the invention with a single layer of material.

As shown in FIG. 3, the body of the garment includes a tunnel 12. In an embodiment having a single layer of material at the body, the tunnel is formed from a strip material. The strip is sewn or attached to the body on both side edges to form the tunnel. In an embodiment, a one inch strip of material is attached from the lower side seam to an opening in the shoulder, which may be finished with an eyelet having a size, for example, about ¼ inch inside diameter. When each side of the length of the strip is sewn from the lower seam to the eyelet, a tunnel pathway for the cord to run through is formed. In an embodiment, the body of the garment comprises two layers of material sewn together to form the tunnel 12 with enough space for cord to be able to move freely through it. The tunnel keeps the cord in proper placement so it will not slip down over the shoulder or be tangled in movement. The tunnel 12, within which the cord is located, extends from an opening in the shoulder to a bottom seam 4 of the garment.

Figure 4:
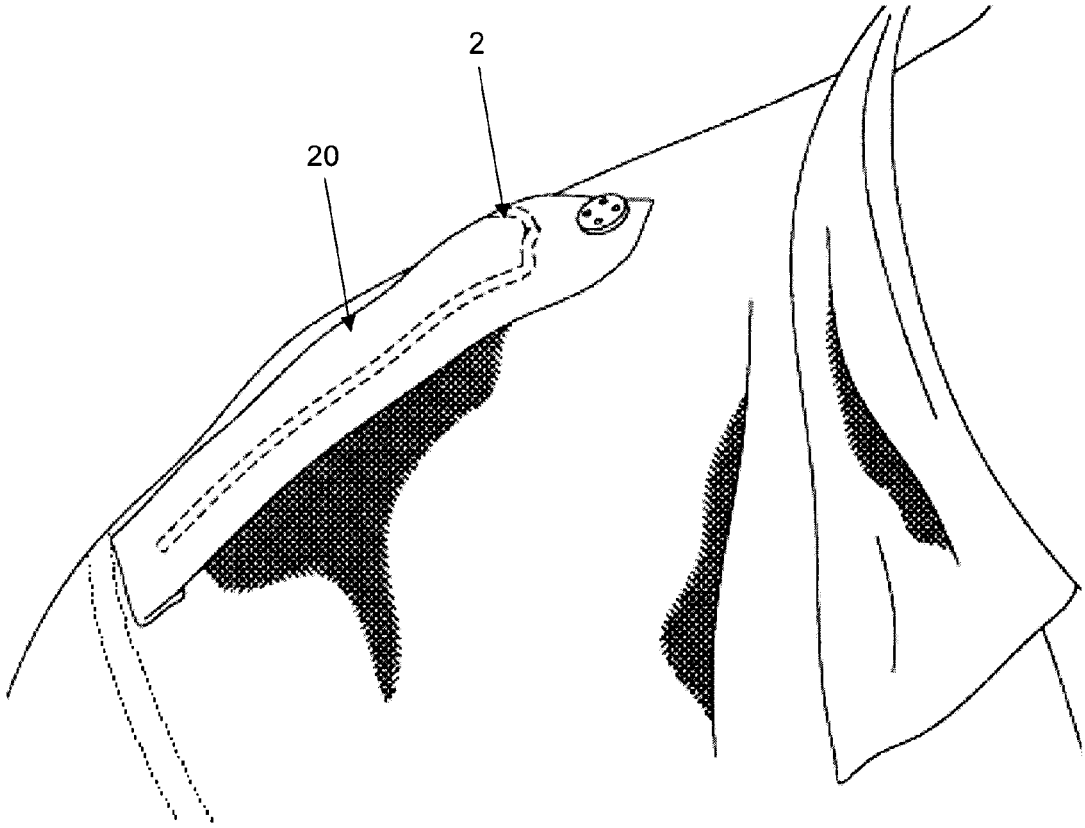
FIG. 4 is a detail perspective showing cord placement in an epaulette.
Figure 5:
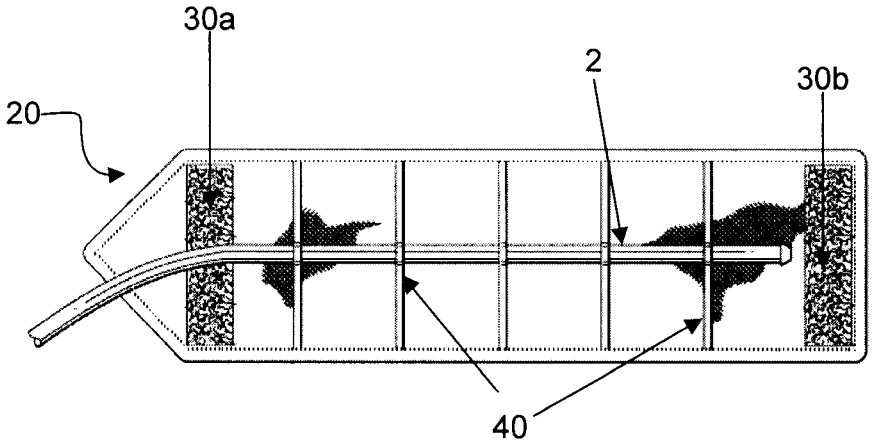
FIG. 5 is a bottom view of an epaulette showing cord placement.

Referring to an embodiment depicted in FIG. 4, the cord 2 exits the body 1 at the shoulder under the removable piece 20. The cord 2 exits from the body 1 and is attached to and concealed in or under the removable piece 20. In an embodiment depicted in FIG. 5, the cord 2 is fixed at various points to an epaulette on the bottom side. In an embodiment, the cord is fixed between two pieces of cloth that form the epaulette. The end of the cord (opposite the end fixed at the bottom section) is firmly attached to the removable piece. In an embodiment, the removable piece comprises pieces 40 to add stability and prevent tearing, etc.

Figure 6:
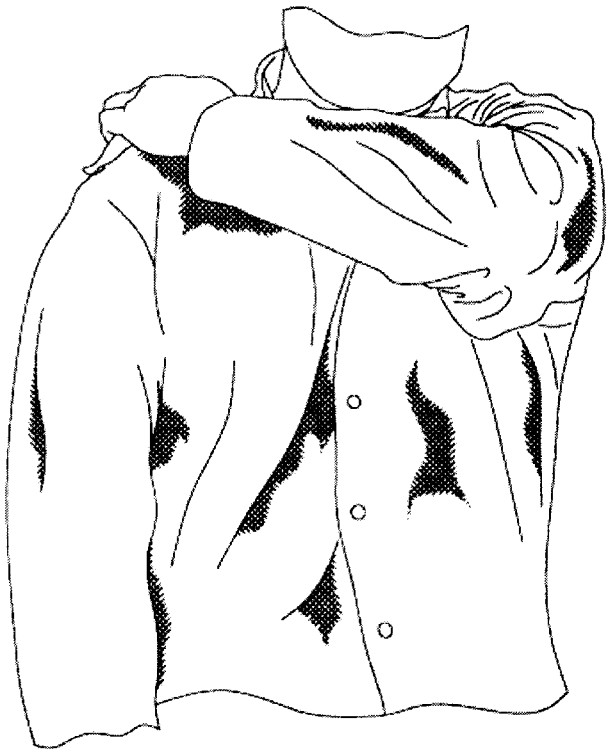
FIG. 6 is a perspective view of a garment n a user being activated.
Figure 7:
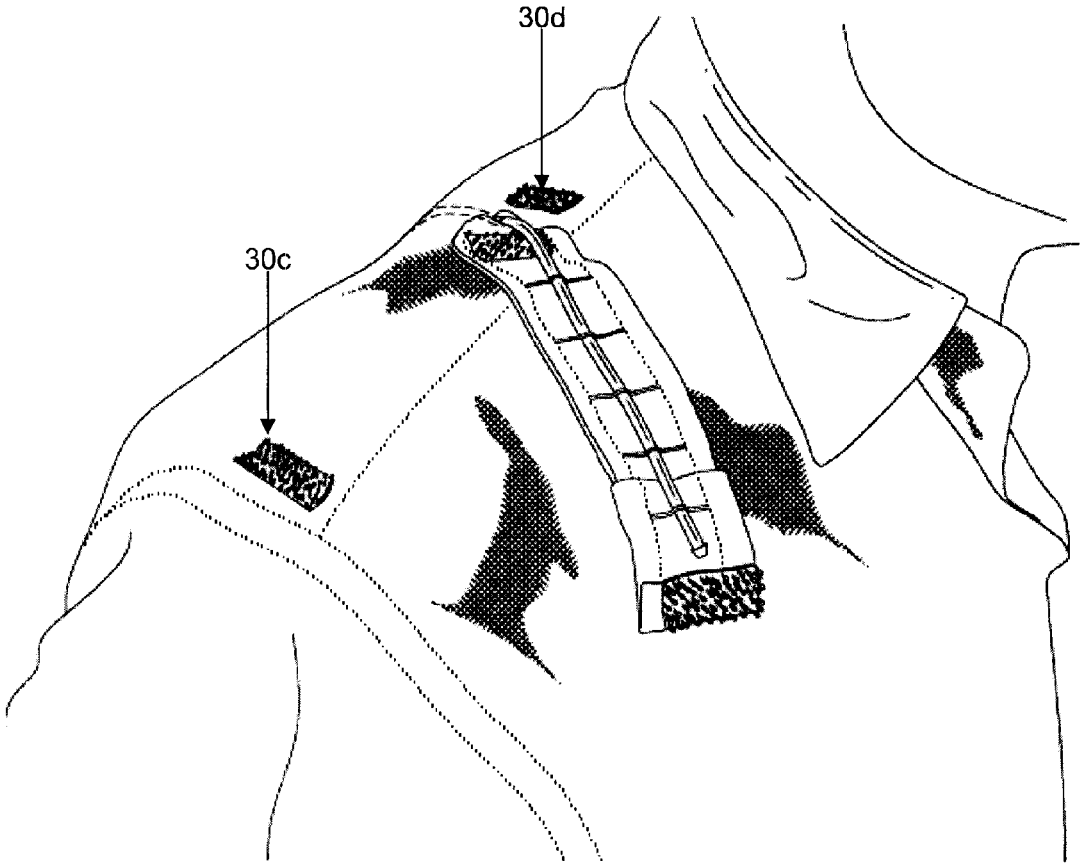
FIG. 7 is a perspective view of an epaulette removed from the shoulder fastener.

As shown in FIG. 6, in an embodiment using an epaulette, a user grasps the epaulette and pulls it down, which pulls the cord 2. The cord pulls the bottom edge of the body of the garment up, revealing a weapon carried on the user's belt. As depicted in FIG. 7, the removable piece is removeably attached to the body by any known fastening means 30*a,b,c,d*, such as snaps, tabs, clips, hooks or a hook and loop-type fastener attached to the removable piece and the body. "Hook and loop-type" means of the type employed in separable fasteners that are marketed by Velcro USA, Inc., 406 Brown Avenue, Manchester, N.H., under the trademarks VELCRO® hook and loop fasteners, and VELCRO STICKY BACK™ strips of hook and loop fasteners with adhesive backing type of VELCRO® brand tape which has a peel-off backing. The tape is also sold under the STICKY BACK® brand name.

Figure 8:
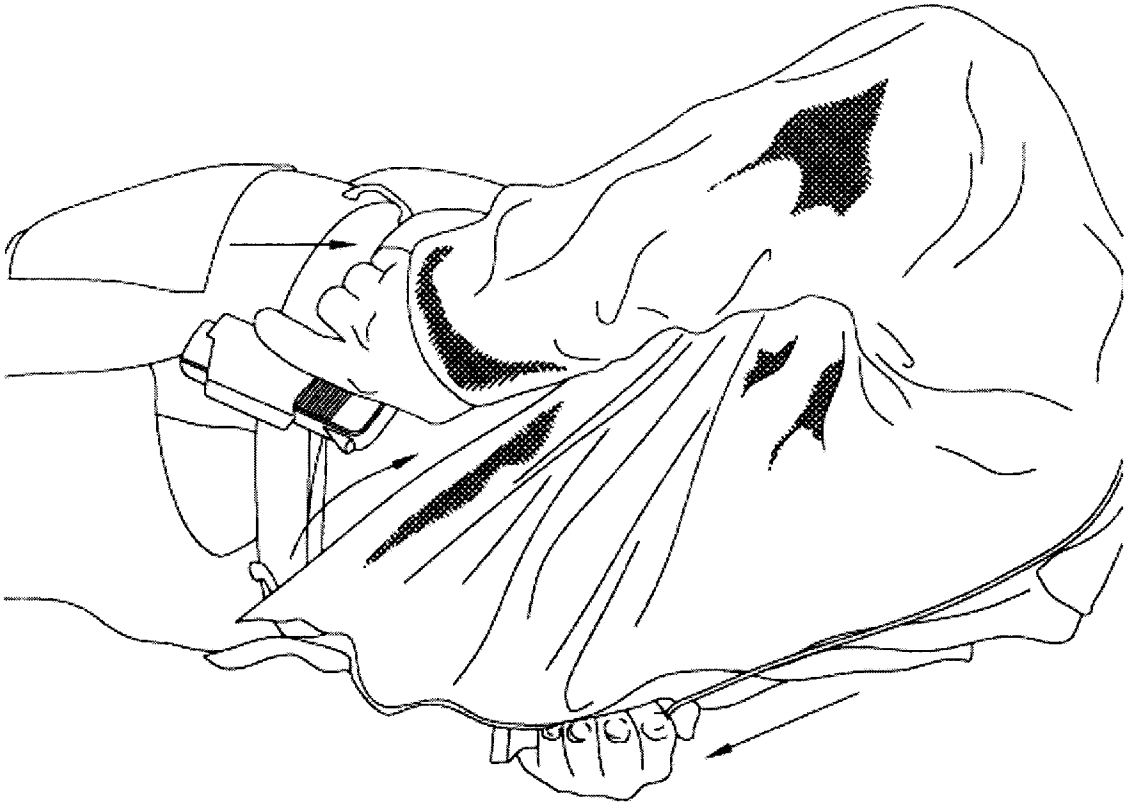
FIG. 8 is a perspective side view of a garment on a user with the garment activated, the pull cord fully extended, and the garment raised to expose the weapon and holster.

FIG. 8 depicts a user removing a concealed weapon as the garment has been deployed. The invention includes accommodations for left-handed or persons that can use either hand as well.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated. It is therefore to be understood that within the scope of the appended claims, the invention may be practiced otherwise than as specifically described herein.

What is claimed is:

1. A garment comprising:

at least one layer of material forming the garment, the garment having right and left sides, an interior and an exterior, an upper exterior, an opening located on said upper exterior, and a lower section, the garment configured to be worn about a wearer's upper torso such that the lower section of the garment will conceal a weapon carried on a wearer's hip;

a concealed passageway within or upon the garment, the passageway extending from said opening on the upper exterior of the garment to said lower section of the garment;

a removable piece removeably attached to the upper exterior of the garment; and a flexible cord attached at an end of the passageway to the lower section at a side of the garment, extending through the passageway and through the opening, and attached to said removable piece adjacent the opening;

said removable piece and attached cord being operative to move the lower section of the garment, at the side of the garment to which the cord is secured, upwardly away from a wearer's hip so as to facilitate access to a weapon carried on a wearer's hip in response to a pulling movement of the removable piece away from said opening.

2. The garment of claim 1 wherein the removable piece is an item that normally appears on garments selected from the group consisting of an epaulette, a shoulder tab, a button, an artificial flower, a handkerchief, a piece of jewelry, a collar and a lapel.

3. The garment of claim 1 wherein the removable piece is removeably attached by a fastener selected from at least one of a snap, a tab, a clip, a hook and a hook and loop-type fastener.

4. The garment of claim 1 wherein the garment is a shirt and the removable piece is a shoulder tab.

5. The garment of claim 1 wherein the lower section of the garment is a bottom of the garment at a side seam.

6. The garment of claim 1 wherein the removable piece is located on a left side of the garment.

7. The garment of claim 1 wherein the removable piece is located on a right side of the garment.

8. The garment of claim 1 further comprising a second passageway, a second removable piece removeably attached to the upper exterior of the garment, and a second flexible cord attached at an end of the second passageway to the lower section of the garment, extending through the second passageway and attached to said second removable piece, one of said passageways extending from the lower section of the garment at a bottom of the garment at a first side seam, and the other one of said passageways extending from the lower section of the garment at a second side seam, and further wherein one of said cords is attached to a removable piece removeably attached to a left side of the garment and the other cord is attached to a removable piece removeably attached to a right side of the garment.

9. A method of accessing a user-carried concealed weapon worn on the user's belt comprising the steps of:

a) donning an upper torso garment such that the weapon is concealed by a lower section of the garment, the garment comprising a replaceable removable piece removably located on an upper exterior of the garment, an opening located on the upper exterior of the garment, and a cord which is attached at one end to said removable piece, wherein said cord extends through said opening into the garment and is attached at an opposite end to a lower section of the garment, said lower section of the garment proximate to the concealed weapon covered by the garment;

b) grasping the removable piece; and c) pulling the removable piece off of the garment in a direction away from the opening on the upper exterior of the garment whereby the cord raises the lower section of the garment and allows access to the weapon.

10. The method of claim 9 further comprising the step of replacing the removable piece on the upper exterior of the garment such that the lower section lowers to its original position.

* * * * *